United States Patent [19]

Cohen et al.

[11] Patent Number: 4,532,065

[45] Date of Patent: Jul. 30, 1985

[54] METHOD AND COMPOSITION FOR CLEANING ANODIZED ALUMINUM

[75] Inventors: Leon E. Cohen, Highland Park; John A. Hook, Trenton, both of N.J.

[73] Assignee: FMC Corporation, Philadelphia, Pa.

[21] Appl. No.: 270,772

[22] Filed: Jun. 5, 1981

[51] Int. Cl.[3] ..... C11D 7/10; C11D 3/06

[52] U.S. Cl. ..... 252/135; 252/133; 252/156; 252/DIG. 14; 148/6.27; 134/2; 134/42

[58] Field of Search ..... 252/80, 81, 87, 135, 252/181, DIG. 14, DIG. 11, 133, 387; 148/6.27; 134/2, 42; 422/19

[56] References Cited

U.S. PATENT DOCUMENTS

| | | | |
|---|---|---|---|
| 2,050,122 | 8/1936 | Reuss et al. | 252/156 |
| 2,748,035 | 5/1956 | Duncan | 252/141 |
| 2,836,566 | 5/1958 | Duncan | 252/529 |
| 3,116,105 | 12/1963 | Kerst et al. | 252/DIG. 11 |
| 3,547,817 | 12/1970 | Hansen et al. | 252/181 |
| 3,639,263 | 2/1972 | Troscinski et al. | 252/181 |
| 3,923,539 | 12/1975 | Jorns | 252/387 |

FOREIGN PATENT DOCUMENTS

| | | |
|---|---|---|
| 1598686 | 1/1968 | France . |
| 1576434 | 6/1969 | France . |
| 22388 | 6/1980 | Japan . |

OTHER PUBLICATIONS

Products Finishing, Oct. 1976, Dr. R. Satee.
Products Finishing, Nov. 1977, J. M. Kape.
The Chemical Formulary, vol. 5, pp. 294–297, H. Bennet, 1941, Chemical Publishing Co., Inc., New York 10, N.Y.

*Primary Examiner*—Paul Lieberman
*Assistant Examiner*—Hoa Van Le
*Attorney, Agent, or Firm*—Robert D. Jackson; Frank Ianno

[57] ABSTRACT

Cleansing compositions useful in cleaning anodized aluminum contain a detergent builder, a detergent agent and a soluble salt of a transition metal. The presence of the transition metal ion protects the anodized coating from attack by the detergent builder.

6 Claims, No Drawings

METHOD AND COMPOSITION FOR CLEANING ANODIZED ALUMINUM

This invention relates to inhibited cleansing compositions especially suited for the cleaning of anodized aluminum surfaces and methods of using such compositions.

It is well-known to form an anodic coating on aluminum in order to protect the metal surface from weathering and other harsh environmental conditions. Such coatings are produced by passing an electric current through a suitable electrolytic cell with the aluminum connected as the anode, the aluminum surface being converted to an adherent and durable layer of aluminum oxide.

Anodized aluminum is a material of choice where specifications call for a light-weight, corrosion resistant material. In the automotive industry, for instance, anodized aluminum is being used to fabricate external vehicle parts such as bumpers, wheel covers, mirror frames, and mouldings as a means of reducing vehicle weight for improved fuel efficiency; mass transportation vehicles and vehicles of commerce, such as trucks, also contain aluminum parts to minimize vehicle weight. In the building and construction industry, panels of anodized aluminum are used for outer walls and other external applications such as support brackets, decorative trim and the like.

Although affording generally excellent protection for the aluminum substrate, the anodic coating thereon may undergo a characteristic deterioration which has come to be known as "aluminum blush". It is manifested by a permanent surface discoloration, involving corrosion of the aluminum oxide coating. Concern about the aluminum blush problem is of relatively recent origin, and is attributable primarily to increased use of aluminum in automotive vehicles and the growth of commercial car wash facilities employing special detergent mixes for cleaning the vehicles.

The protective anodic coating on anodized aluminum consists of tightly packed, closed cells of aluminum oxide, predominately hexagonal in shape, each of which has a single tapered pore. These cells vary in size, depending upon the anodization electrolyte and voltage, between 800 and 2,800 angstroms while the pores vary between 120 and 330 angstroms. Coating thickness is controlled by adjusting the anodization process parameters; for automotive applications, the coating thickness is usually 0.3 to 0.4 mills. There is normally a solid barrier layer between the upper cellular layer and metal substrate. As initially formed, the anodic coating has an open pore structure. It is given a post anodizing sealing treatment to effect pore closure and thereby convert it into a durable, protective film.

The most common of the anodizing processes and the one with which the present invention is particularly concerned with, is sulfuric acid anodizing. In this process, sulfuric acid is used as the electrolyte while sealing is effected by immersing the coating in a dilute solution of a transitional metal salt, usually a nickel salt such as nickel acetate. The metal ions diffuse into the cellular aluminum oxide layer, lodging in the pores, to provide the finished sealed anodic coating.

The cleansing compositions used by commercial car washers are usually of the heavy duty, industrial type. They contain a detergent, high percentage of a detergent builder and usually an inorganic neutral or alkaline compound. The builders are chelating agents which form soluble complexes with hard water ions such as magnesium and calcium which can interfere with the cleansing action of the detergent. The alkaline and neutral compounds are commonly added as fillers, although alkaline substances can enhance cleansing action. Inclusion of the latter may elevate alkalinity sufficiently to require the presence of corrosion inhibitors, usually an alkali metal silicate such as sodium silicate.

An investigation of the aluminum blush problem implicated the detergent builder component in the cleansing composition as a causative factor. Subsequent studies established that the builder forms a stable complex with the metal ions used in sealing the anodic coating, resulting in a reversion of the cellular aluminum oxide layer to its original open pore configuration. This greatly diminishes the protective action of the film, rendering it susceptible to attack by harsh environmental conditions such as road and detergent chemicals, atmospheric pollutants and the like. The resulting surface deterioration or discoloration has come to be known as "chelate blush" to distinguish it from gross corrosion of anodized aluminum under extreme conditions of acidity or alkalinity.

It is, therefore, an object of the present invention to provide improved detergent compositions for cleaning anodized aluminum surfaces wherein chelate blush attack of said surfaces by the detergent composition is substantially eliminated. Other objects and purposes will become apparent subsequently herein.

Pursuant to the objects aforesaid, anodized aluminum surfaces can be cleaned without developing aluminum chelate blush by washing the surfaces with an aqueous solution of a detergent composition containing a detergent, a detergent builder and a soluble salt of a transition metal. The present invention is predicated on the unexpected discovery that transition metal ions in the detergent solution form highly stable complexes with the detergent builder thereby neutralizing its capacity for abstracting transition metal ions from the anodic coating. As above pointed out, removal of the transition metal ions from the anodic coating restores the porosity of the upper aluminum oxide layer and consequent loss of its protective properties.

Sufficient transition metal salt should be included in the detergent solution to at least saturate the transition metal chelating affinity of the detergent. Normally the detergent builder forms a complex with the transition metal ions. Forming the transition metal complex of the builder does not interfere with its normal function of sequestering hard water ions, for example, calcium and magnesium ions. Generally speaking, a weight ratio of transition metal ion to builder of at least about 0.006 is satisfactory, depending on the chelating power of the particular class of builders. For instance, the weight ratio aforesaid suffices for the less aggressive builders such as alkali metal polyphosphates, for example, sodium or potassium tripolyphosphate. Builders having stronger chelating power, as exemplied by tetrasodium pyrophosphate, will require a higher ratio, on the order of 0.012. The strongest chelating builders are the organic types such as ethylenediamine tetraacetic acid, EDTA which requires a mininum ratio of transition metal ion to builder of about 0.024. A slight excess of transition metal ions in the cleansing solution may be desirable but a large excess, although not deleterious, should be avoided in the interest of economy. The source of the herein transition metal ion can be any soluble transition metal salt including halides, for example, chloride, bromide or fluoride, acetate, sulfate, nitrate or the like; preferred salts are water-soluble salts of nickel and cobalt, particularly nickel. By water-soluble herein is meant a solubility of at least 1% by weight at 25° C.

Although the detergent agent, detergent builder and soluble transition metal salt can be employed individually in formulating the detergent solutions of the invention, it is generally more convenient to prepare a dry blend of these components and the resulting formulation added to water.

Detergent agents suitable for use in accordance with the invention encompass a relatively wide range of surfactants which may be of the anionic, non-ionic, cationic or amphoteric types.

The anionic surface active agents include those surface active or detergent compounds which contain an organic hydrophobic group and an anionic solubilizing group. Typical examples of anionic solubilizing groups are sulfonate, sulfate, carboxylate, phosphonate and phosphate. Examples of suitable anionic detergents which fall within the scope of the invention include the soaps, such as the water-soluble salts of higher fatty acids or rosin acids, such as may be derived from fats, oils, and waxes of animal, vegetable or marine origin, for example, the sodium soaps of tallow, grease, coconut oil, tall oil and mixtures thereof; and the sulfated and sulfonated synthetic detergents, particularly those having about 8 to 26, and preferably about 12 to 22, carbon atoms to the molecule.

As examples of suitable synthetic anionic detergents the higher alkyl mononuclear aromatic sulfonates are preferred, particularly the LAS type such as the higher alkyl benzene sulfonates containing from 10 to 16 carbon atoms in the alkyl group, for example, the sodium salts such as decyl, undecyl, dodecyl(lauryl), tridecyl, tetradecyl, pentadecyl, or hexadecyl benzene sulfonate and the higher alkyl toluene, xylene and phenol sulfonates; alkyl naphthalene sulfonate, ammonium diamyl naphthalene sulfonate, and sodium dinonyl naphthalene sulfonate.

Other anionic detergents are the olefin sulfonates, including long chain alkene sulfonates, long chain hydroxyalkane sulfonates or mixtures of alkenesulfonates and hydroxyalkanesulfonates. These olefin sulfonate detergents may be prepared, in known manner, by the reaction of $SO_3$ with long chain olefins (of 8-25 preferably 12-21 carbon atoms) of the formula $RCH{=}CHR_1$, where R is alkyl and $R_1$ is alkyl or hydrogen, to produce a mixture of sultones and alkenesulfonic acids, which mixture is then treated to convert the sultones to sulfonates. Examples of other sulfate or sulfonate detergents are paraffin sulfonates, such as the reaction products of alpha olefins and bisulfites (for example, sodium bisulfite), for example, primary paraffin sulfonates of about 10–20 preferably about 15–20 carbon atoms; sulfates of higher alcohols; salts of α-sulfofatty esters (for example, of about 10 to 20 carbon atoms, such as methyl α-sulfomyristate or α-sulfotallowate).

Examples of sulfates of higher alcohols are sodium lauryl sulfate, sodium tallow alcohol sulfate; Turkey Red Oil or other sulfated oils, or sulfates of mono- or diglycerides of fatty acids (for example, stearic monoglyceride monosulfate), alkyl poly(ethoxy) ether sulfates such as the sulfates of the condensation products of ethylene oxide and lauryl alcohol (usually having 1 to 5 ethoxy groups per molecule); lauryl or other higher alkyl glyceryl ether sulfonates; aromatic poly(ethoxy) ether sulfates such as the sulfates of the condensation products of ethylene oxide and nonyl phenol (usually having 1 to 20 oxyethylene groups per molecule, preferably 2-12).

The suitable anionic detergents include also the acyl sarcosinates (for example, sodium lauroylsarcosinate), the acyl ester (for example, oleic acid ester) of isothionates, and the acyl N-methyl taurides (for example, potassium N-methyl lauroyl or oleyl tauride).

Other highly preferred water-soluble anionic detergent compounds are the ammonium and substituted ammonium (such as mono-, di- and triethanolamine), alkali metal (such as sodium and potassium) and alkaline earth metal (such as calcium and magnesium) salts of the higher alkyl sulfates, and the higher fatty acid monoglyceride sulfates. The particular salt will be suitably selected depending upon the particular formulation and the proportions therein.

Nonionic surface active agents include those surface active or detergent compounds which contain an organic hydrophobic group and a hydrophilic group which is a reaction product of a solubilizing group such as carboxylate, hydroxyl, amido or amino with ethylene oxide or polyethylene glycol.

As examples of nonionic surface active agents which may be used there may be noted the condensation products of alkyl phenols with ethylene oxide, for example, the reaction product of octyl phenol with about 6 to 30 ethylene oxide units; condensation products of alkyl thiophenols with 10 to 15 ethylene oxide units; condensation products of higher fatty alcohols such as tridecyl alcohol with ethylene oxide; ethylene oxide condensates of monoesters of hexahydric alcohols and inner ethers thereof such as sorbitol monolaurate, sorbitol monooleate and mannitol monopalmitate, and the condensation products of polypropylene glycol with ethylene oxide.

Cationic surface active agents may also be employed. Such agents are those surface active detergent compounds which contain an organic hydrophobic group and a cationic solubilizing group. Typical cationic solubilizing groups are amine and quaternary groups.

As examples of suitable synthetic cationic detergents there may be noted the diamines such as those of the type $RNHC_2H_4NH_2$ wherein R is an alkyl group of about 12 to 22 carbon atoms, such as N-2-aminoethyl stearyl amine and N-2-aminoethyl myristyl amine; amide-linked amines such as those of the type $R_1CONHC_2H_4NH_2$ wherein R is an alkyl group of about 9 to 20 carbon atoms, such as N-2-amino ethyl stearyl amide and N-amino ethyl myristyl amide; quaternary ammonium compounds wherein typically one of the groups linked to the nitrogen atom are alkyl groups which contain 1 to 3 carbon atoms; including such 1 to 3 carbon alkyl groups bearing inert substituents such as phenyl groups, and there is present an anion such as halide, acetate, methosulfate, etc. Typical quaternary ammonium detergents are ethyl-dimethyl-stearyl ammonium chloride, benzyl-dimethyl-stearyl ammonium chloride, benzyl-dimethyl-stearyl ammonium chloride, trimethyl stearyl ammonium chloride, trimethylcetyl ammonium bromide, dimethyl ethyl dilauryl ammonium chloride, dimethyl-propyl-myristyl ammonium chloride, and the corresponding methosulfates and acetates.

Examples of suitable amphoteric detergents are those containing both an anionic and a cationic group and a hydrophobic organic group, which is advantageously a higher aliphatic radical, for example, of 10–20 carbon atoms. Among these are the N-long chain alkyl aminodicarboxylic acids, for example, of the formula:

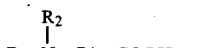

The N-long chain alkyl iminodicarboxylic acids (for example, of the formula $RN(R'COOH)_2$) and the N-long chain alkyl betaines, for example, of the formula:

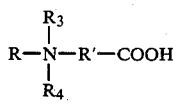

where R is a long chain alkyl group, for example, of about 10–20 carbons, R'is a divalent radical joining the amino and carboxyl portions of an amino acid (for example, an alkylene radical of 1–4 carbon atoms), H is hydrogen or a salt-forming metal, $R_2$ is a hydrogen or another monovalent substituent (for example, methyl or other lower alkyl), and $R_3$ and $R_4$ are monovalent substituents joined to the nitrogen by carbon-to-nitrogen bonds (for example, methyl or other lower alkyl substituents). Examples of specific amphoteric detergents are N-alkyl-beta-amino-propionic acid; N-alkyl-beta-iminodipropionic acid, and N-alkyl, N,N-dimethyl glycine; the alkyl group may be, for example, that derived from coco fatty alcohol, lauryl alcohol, myristyl alcohol (or a lauryl-myristyl mixture), hydrogenated tallow alcohol, cetyl, stearyl, or blends of such alcohols. The substituted aminopropionic and iminodiproprionic acids are often supplied in the sodium or other salt forms, which may likewise be used in the practice of this invention. Examples of other amphoteric detergents are the fatty imidazolines such as those made by reacting a long chain fatty acid (for example, of 10 to 20 carbon atoms) with diethylene triamine and monohalocarboxylic acids having 2 to 6 carbon atoms, for example, 1-coco-5-hydroxyethyl-5-carboxy-methylimidazoline; betaines containing a sulfonic group instead of the carboxylic group; betaines in which the long chain substituent is joined to the carboxylic group without an intervening nitrogen atom, for example, inner salts of 2-trimethylamino fatty acids such as 2-trimethylaminolauric acid, and compounds of any of the previously mentioned types but in which the nitrogen atom is replaced by phosphorus.

Detergent builders commonly added to detergent formulations and which are prevented from causing chelate blush of anodized aluminum by the invention are of the chelating type which include a variety of conventional organic and inorganic compounds. Among the commonly used inorganic builders causing aluminum blush are the water-soluble alkali metal pyrophosphates and polyphosphates including higher condensed or glassy phosphates having about 6 to 21 phosphorus atoms per phosphate molecule. Typical inorganic phosphate builders include sodium and potassium tripolyphosphates and pyrophosphates; sodium tripolyphosphate and tetrasodium pyrophosphates are commonly used members. Other commonly used builders causing aluminum chelate blush are the organic polyphosphates such as the sodium and potassium salts of ethane 1-hydroxy-1,1-diphosphonic acid and ethane-1,1,2-triphosphonic acid. Commonly used non-phosphate builders are the sodium salts of nitrolotriacetic acid and ethylenediamine tetraacetic acid (ETDA).

The detergent compositions of the invention are prepared in the known manner using mixing techniques familiar to the cleansing art. Solid blends of the individual detergent component are conveniently formulated and then added to water to give a washing solution containing from about 0.05 to 5% of the detergent mix. The solid detergent formulation will generally contain by weight from about 25% to about 75% of builder, about 10% to about 15% of detergent agent, and sufficient transitional metal salt to saturate the transition metal chelating capacity of the builder, generally in the range of 0.15% to 0.6%.

The invention is illustrated in further detail by the following test procedure and examples:

Aluminum Blush Test Procedure

A 0.25% detergent solution is prepared by dissolving solid detergent in water having a hardness factor of 130 ppm. The solution is heated to 120° F. and so maintained while a specimen of anodized aluminum is immersed therein for 2.5 hours. At the conclusion of the test period, the aluminum is removed from the solution and examined for attack of the anodic coating. Chelate blush is indicated by the presence of open pores in the anodic layer.

The aluminum was a segment of anodized aluminum automobile trim and having the designation alloy 5252.

PREPARATION OF DETERGENT

Example 1

A detergent composition was prepared by intimately blending by weight a mixture of 70% sodium tripolyphosphate, 30% sodium dodecylbenzenesulfonate and sufficient $Ni(NO_3)_2.6H_20$ to provide 0.3% nickel ion. A 0.25% by weight detergent solution was then prepared and tested using the test procedure aforesaid. There was no discernible evidence of chelate blush.

Example 2

The procedure of Example 1 was repeated except the quantity of nickel ion was 0.5%. No discernible chelate blush was evident.

Example 3

The procedure of Example 1 was repeated using 70% tetrasodium pyrophosphate and 0.45% nickel ion. No discernible chelate blush was evident.

Control Example

The procedure of example 1 was repeated but omitting the $Ni(NO_3)_2.6H_20$. Microscopic examination of the test aluminum piece revealed the presence of an extensive open pore network on the anodized surface characteristic of chelate blush. This example demonstrates that detergent builders are capable of opening the pores of the anodized coating on aluminum thereby reducing the metal's resistance to harsh environmental agents. The presence of a transition metal ion in the detergent bath in accordance with the invention prevents such attack of the anodic layer.

We claim:

1. A method of cleaning anodized aluminum by cleaning it with an aqueous solution comprising a detergent agent, a detergent builder and a water-soluble transition metal salt in an amount sufficient to form a transition metal chelate with the detergent builder and thereby protect the anodic coating of the anodized aluminum from attack by solutions of the composition.

2. The method of claim 1 wherein the soluble transition metal salt is a soluble nickel salt.

3. The method of claim 2 wherein the soluble transition metal salt is a soluble cobalt salt.

4. The method of claim 2 wherein the builder is sodium tripolyphosphate. .

5. The method of claim 2 wherein the builder is tetrasodium pyrophosphate.

6. A method of cleaning anodized aluminum by contacting it with an aqueous solution comprising by weight about 25% to about 75% of a detergent builder, about 10% to about 15% of a detergent agent and about 0.15% to about 0.6% of a water-soluble transition metal ion.

* * * * *

UNITED STATES PATENT AND TRADEMARK OFFICE

CERTIFICATE OF CORRECTION

PATENT NO. : 4,532,065

DATED : July 30, 1985

INVENTOR(S) : Leon E. Cohen and John A. Hook

It is certified that error appears in the above-identified patent and that said Letters Patent is hereby corrected as shown below:

Column 2, line 59, "exemplied" should read --exemplified--.
Column 7, line 9, "metal salt is a" should read --metal is a--.

Signed and Sealed this

*Twelfth* Day of *November 1985*

[SEAL]

*Attest:*

*Attesting Officer*

DONALD J. QUIGG

*Commissioner of Patents and Trademarks*